United States Patent [19]

Everman et al.

[11] Patent Number: 4,717,371

[45] Date of Patent: Jan. 5, 1988

[54] APPARATUS FOR MAKING BULK CONTAINERS FROM LAMINATED PAPERBOARD

[75] Inventors: Wayne F. Everman, Cedar Falls; Randy J. Klug, Dike; Raymond L. Russell, Cedar Falls, all of Iowa

[73] Assignee: Container Corporation of America, Alton, Ill.

[21] Appl. No.: 944,861

[22] Filed: Dec. 22, 1986

[51] Int. Cl.[4] ..... B31B 7/00

[52] U.S. Cl. ..... 493/96; 493/130; 493/141; 493/295; 156/558; 156/582

[58] Field of Search ..... 493/76, 87, 95, 96, 493/110, 130, 132, 141, 142, 143, 334, 295; 156/557, 558, 582; 198/404

[56] References Cited

U.S. PATENT DOCUMENTS

| | | | |
|---|---|---|---|
| Re. 21,445 | 5/1940 | Waters . | |
| 2,637,251 | 5/1953 | Spiess | 493/141 |
| 2,902,081 | 9/1959 | Morgan | 156/558 |
| 3,590,699 | 7/1971 | Foleg | 493/110 |
| 3,883,386 | 5/1975 | Garbini et al. | 156/582 |
| 3,964,847 | 6/1976 | Redmer et al. | 198/404 |
| 4,004,395 | 1/1977 | Bardenhagen et al. | 53/396 |
| 4,158,997 | 6/1979 | de Polo | 108/105 |
| 4,205,744 | 6/1980 | Timmons et al. | 198/404 |
| 4,232,777 | 11/1980 | Smith et al. | 198/404 |
| 4,368,052 | 1/1983 | Bitsky et al. | 493/96 |
| 4,500,385 | 2/1985 | Waggoner | 198/404 |
| 4,505,372 | 3/1985 | Sato | 198/404 |
| 4,519,186 | 5/1985 | Winter et al. | 53/292 |
| 4,584,816 | 4/1986 | Mattei et al. | 198/404 |
| 4,650,448 | 3/1987 | Urso | 493/110 |

*Primary Examiner*—Frederick R. Schmidt
*Assistant Examiner*—Robert Showalter
*Attorney, Agent, or Firm*—Richard W. Carpenter

[57] ABSTRACT

Apparatus and method for making a bulk container from a pair of outer and inner blanks of foldable sheet material such as paperboard wherein the blanks are laminated to each other to form a multi-ply sheet then scored to provide fold lines, and then glued and folded to provide a tubular structure.

2 Claims, 10 Drawing Figures

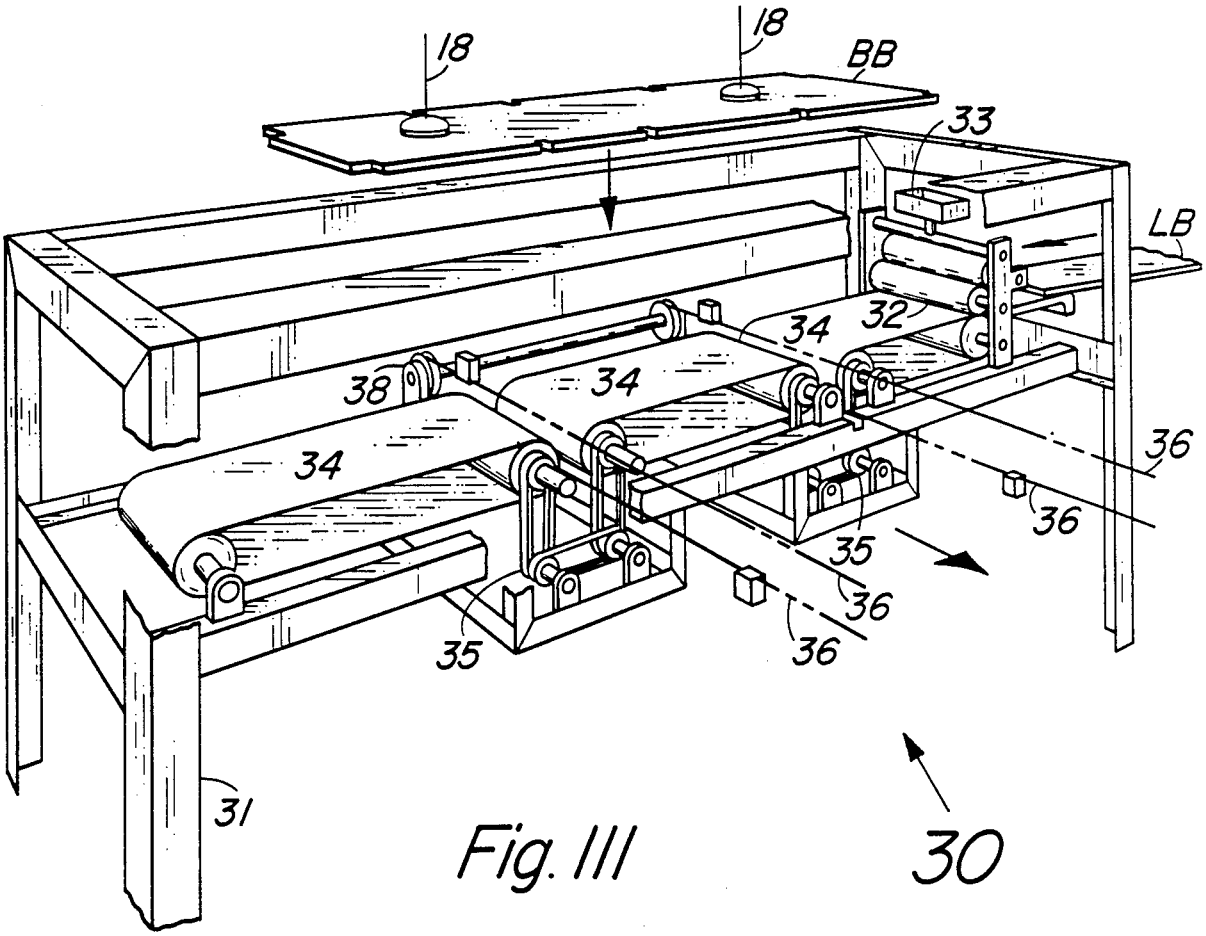
Fig. III
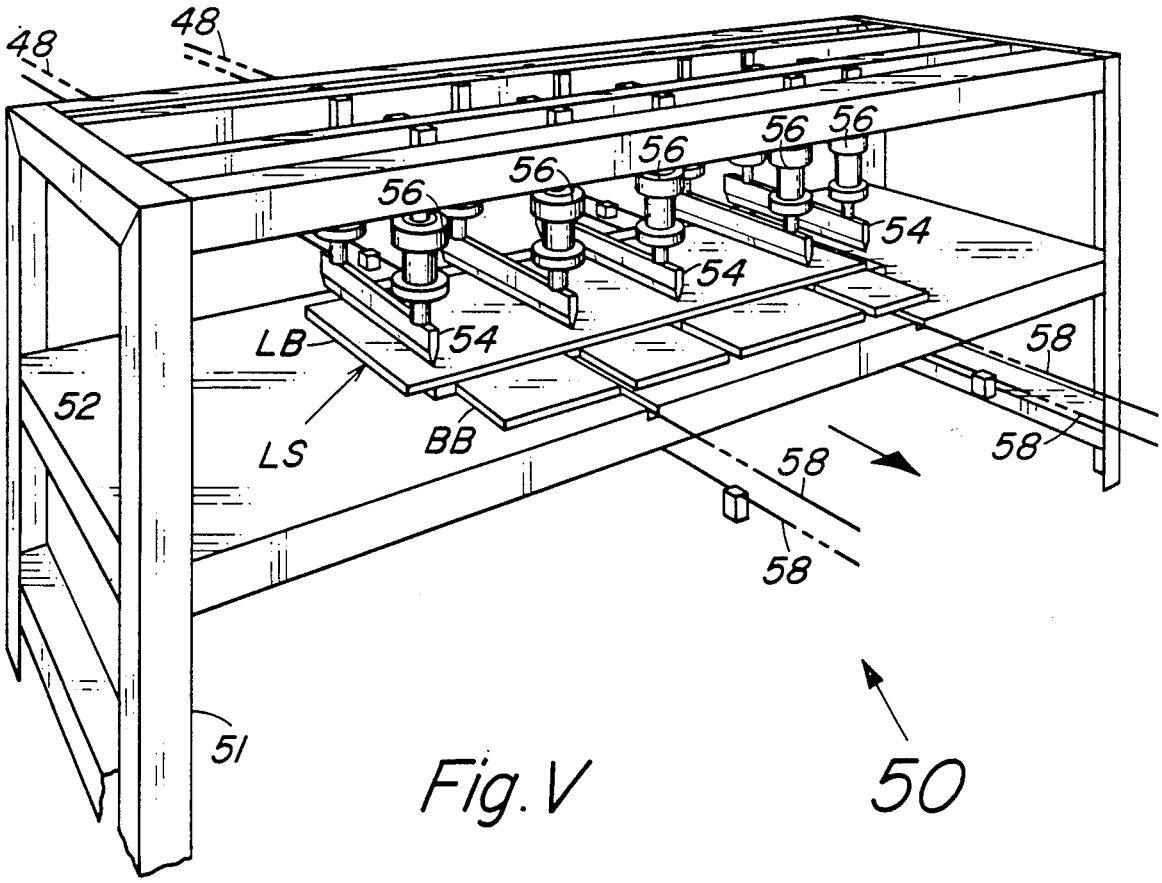
Fig. V

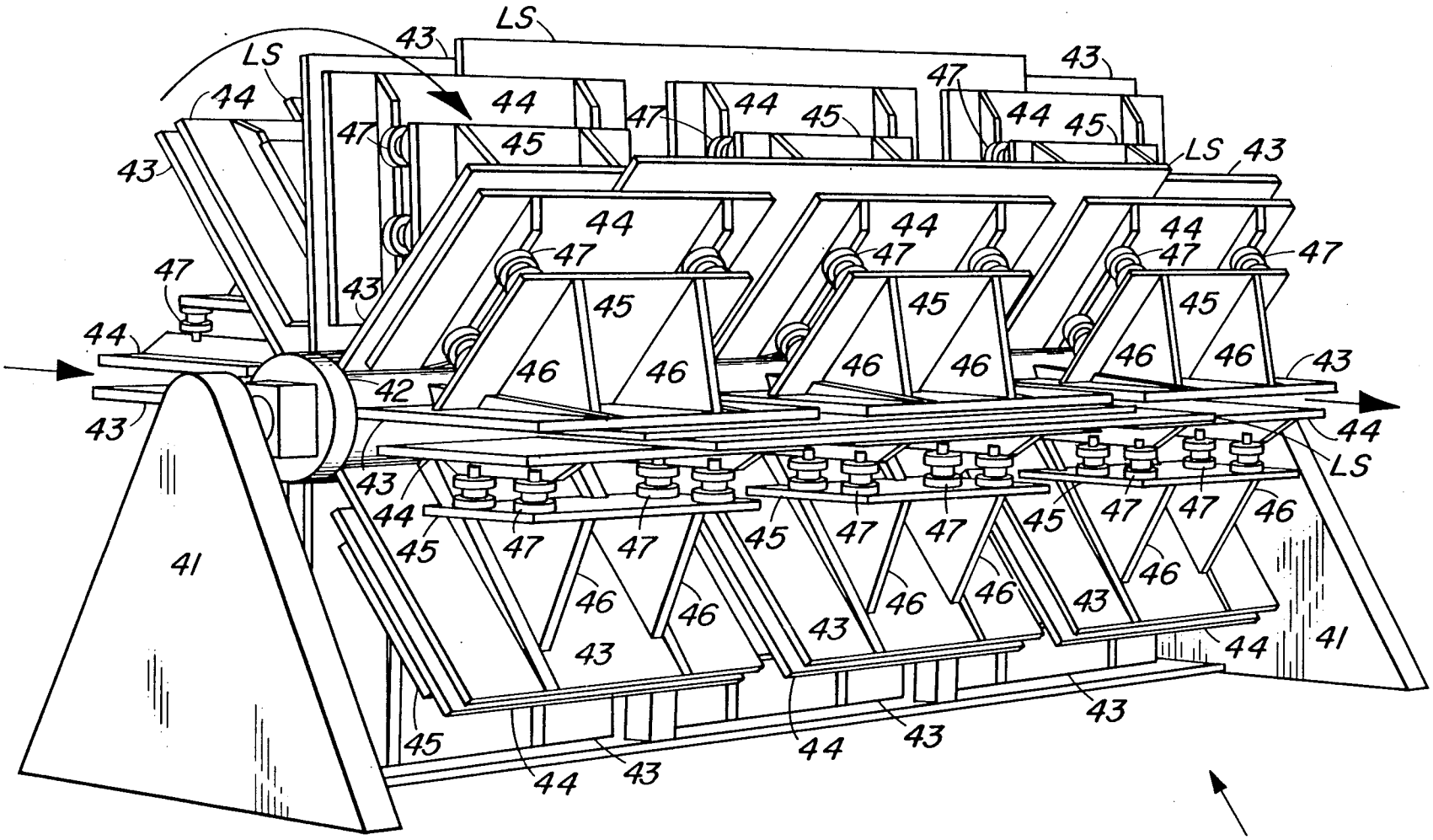
Fig. IV

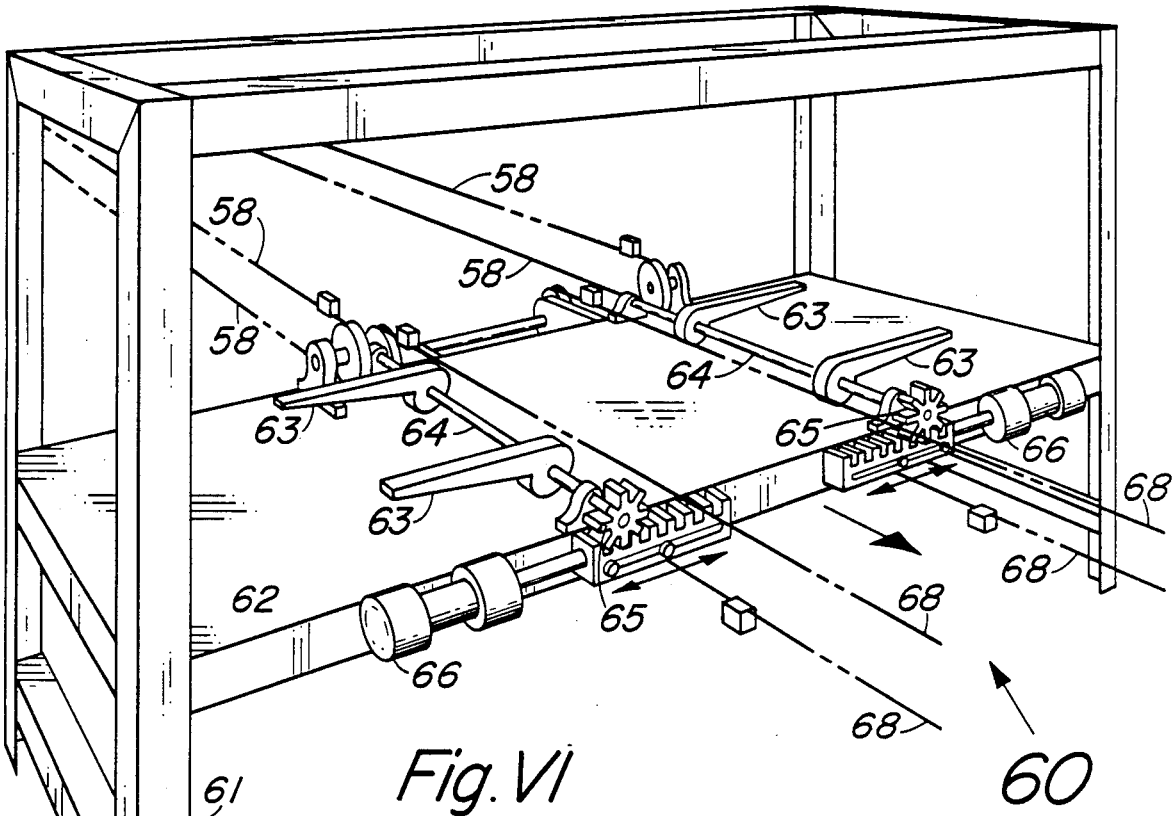
Fig. VI
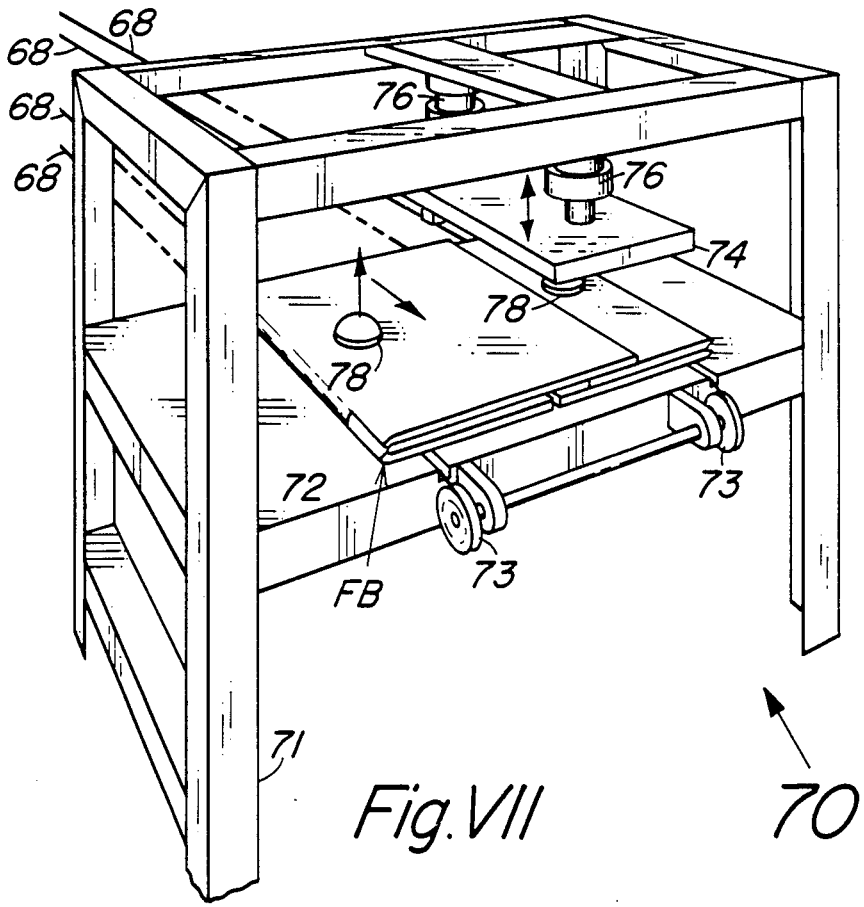
Fig. VII

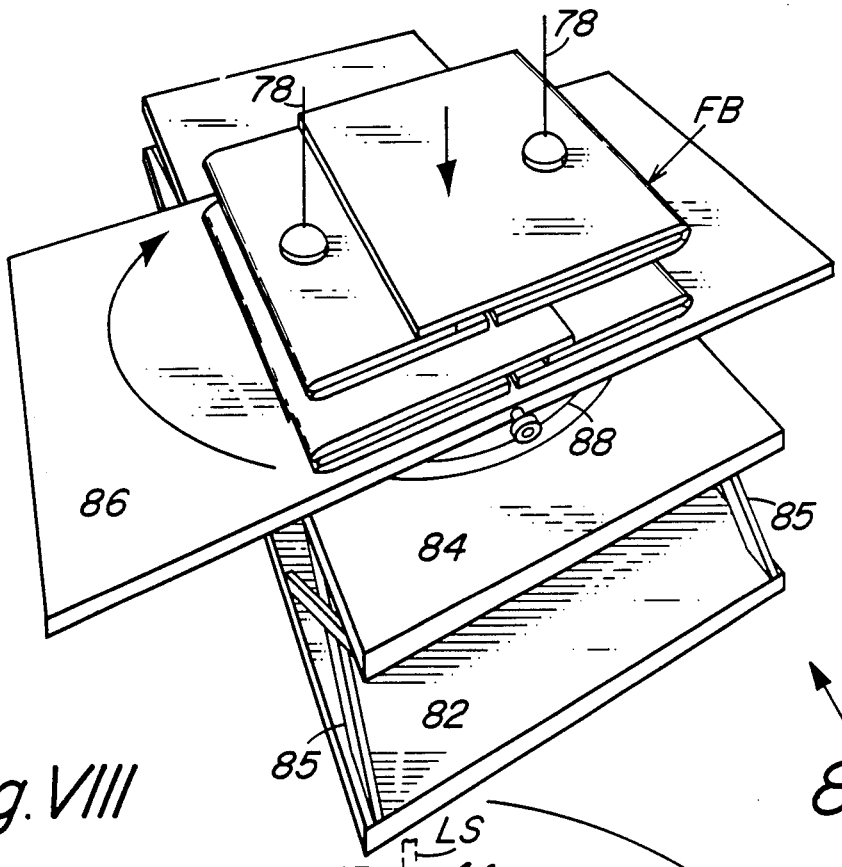
Fig. VIII
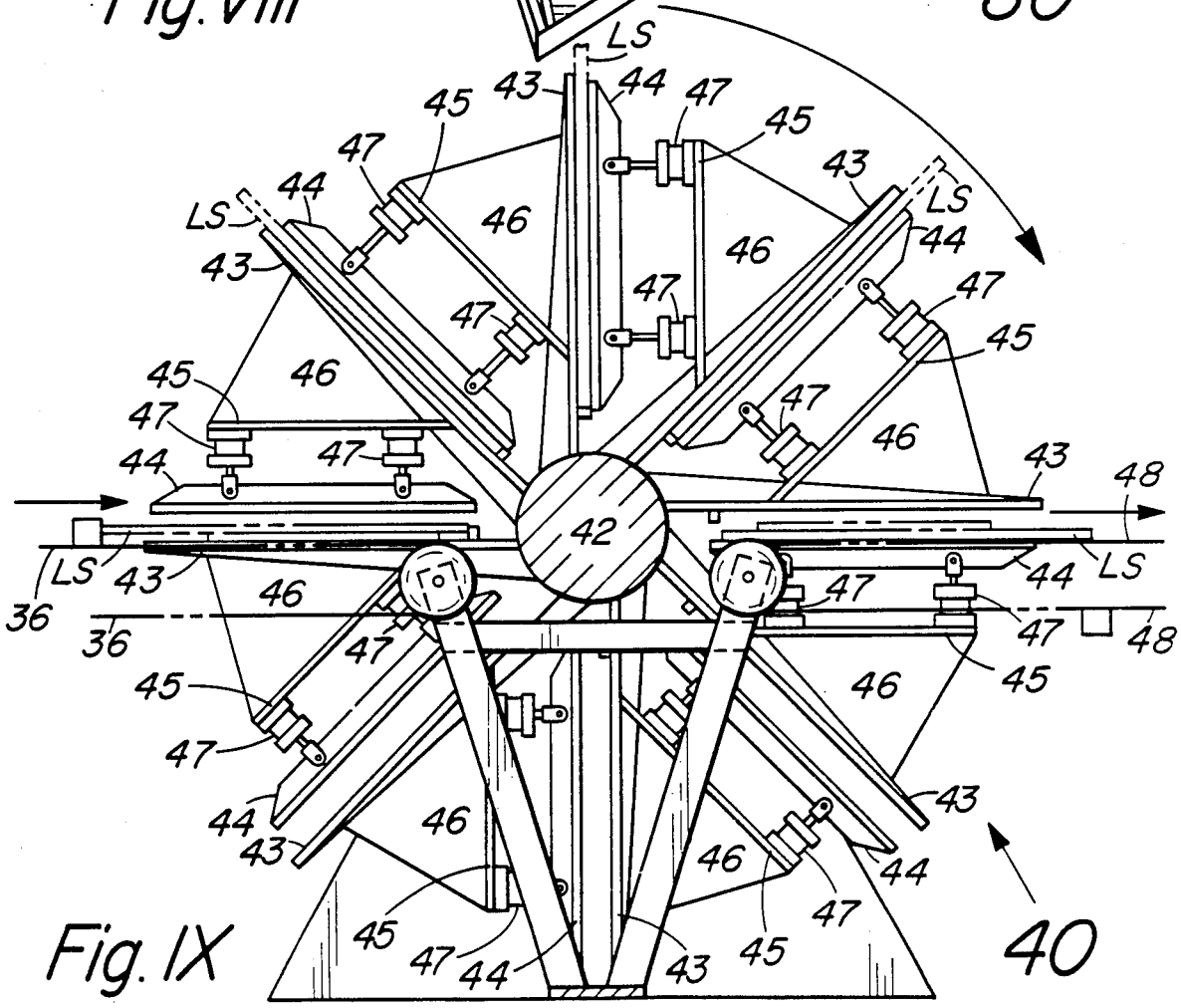
Fig. IX

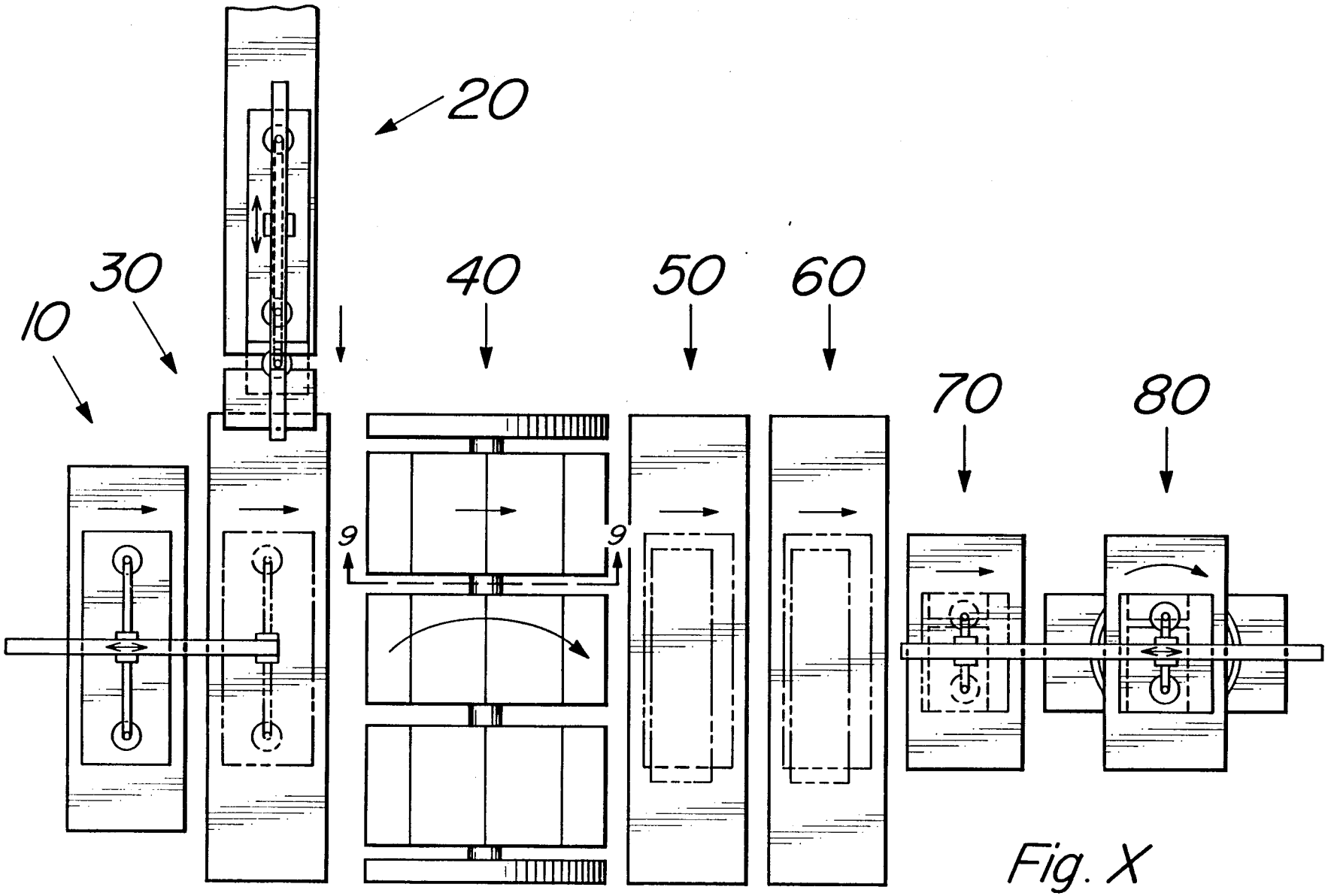
Fig. X

APPARATUS FOR MAKING BULK CONTAINERS FROM LAMINATED PAPERBOARD

BACKGROUND OF THE INVENTION

1. Field of the Invention

This invention relates generally to bulk shipping containers or boxes made of laminated sheet material, such as paperboard and more particularly to an improved method and apparatus for manufacturing same.

2. Description of the Prior Art

A prior art search directed to the subject matter of this application made in the United States Patent and Trademark Office disclosed the following U.S. Pat. Nos. 3,964,847; 4,004,395; 4,205,744; 4,232,777; 4,500,385; 4,505,372; 4,519,186; 4,584,816.

None of the prior art patents uncovered in the search discloses the specific apparatus and method of the present invention wherein a unique ferris wheel type structure is utilized to clamp several sheets of laminated paperboard together at the same time to provide a greater amount of time for the glue to set than provided by conventional equipment, but which requires less floor space than conventional equipment.

SUMMARY OF THE INVENTION

It is an object of the present invention to provide an improved method and apparatus for producing bulk shipping containers from laminated paperboard with a minimum amount of time and space required for handling the material and transporting it between stations.

A more specific object of the invention is the provision of an improved method and apparatus, utilizing a novel ferris wheel type structure, for hold and clamping several laminated sheets of paperboard at the same time, to increase the time for the adhesive to set, without occupying any more floor space than conventional laminating equipment.

These and other objects of the invention will be apparent from an examination of the following description and drawings.

BRIEF DESCRIPTION OF THE DRAWINGS

FIGS. 1 and 2 are fragmentary perspective views of the apparatus employed in the present invention at the outer body blank and inner blank feed stations, respectively;

FIG. 3 is a fragmentary perspective view of the apparatus at the laminating station;

FIG. 4 is a fragmentary perspective view of the apparatus at the first clamping station;

FIG. 5 is a fragmentary perspective view of the apparatus at the scoring station;

FIG. 6 is a fragmentary perspective view of the apparatus at the folding station;

FIG. 7 is a fragmentary perspective view of the apparatus at the second clamping station;

FIG. 8 is a fragmentary perspective view of the apparatus at the container take away station;

FIG. 9 is an end elevational view of the structure shown in FIG. 4; and

FIG. 10 is a schematic diagram illustrating the relative locations of the operating stations employed in the present invention.

Figure 1:
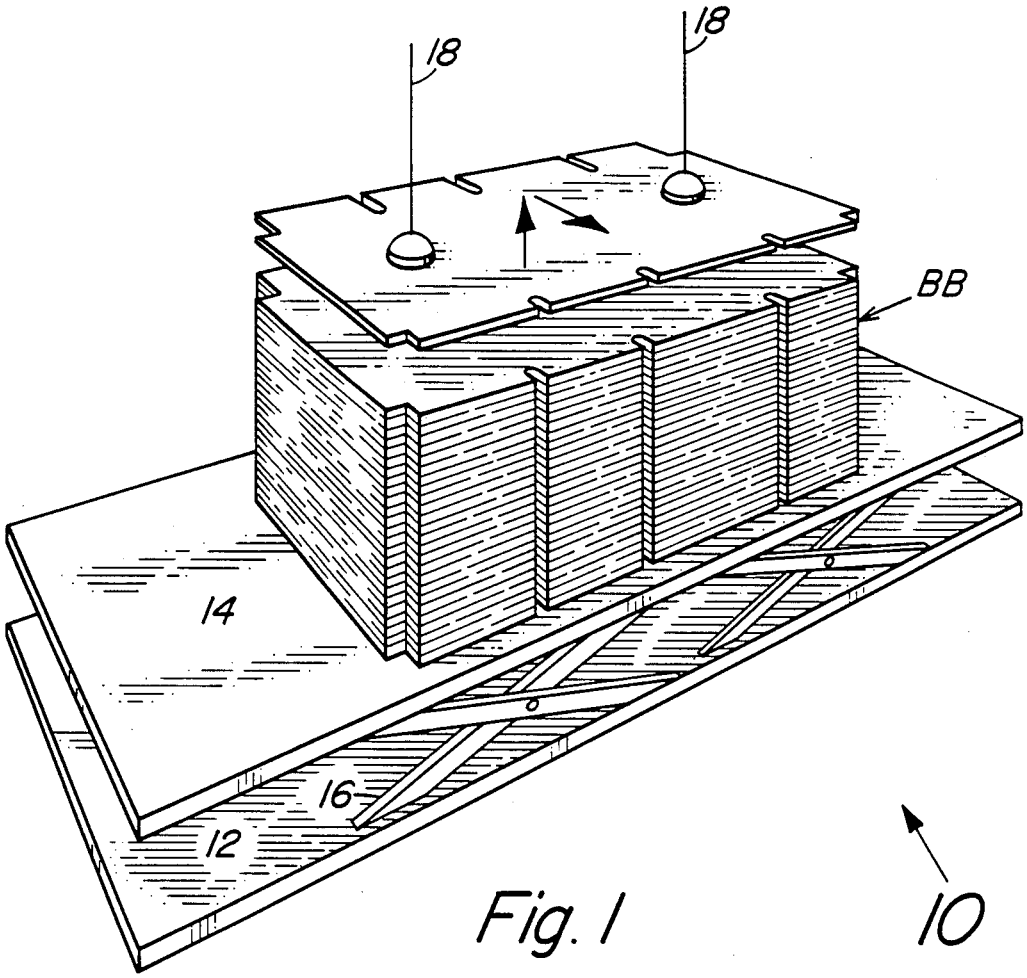
Figure 11:
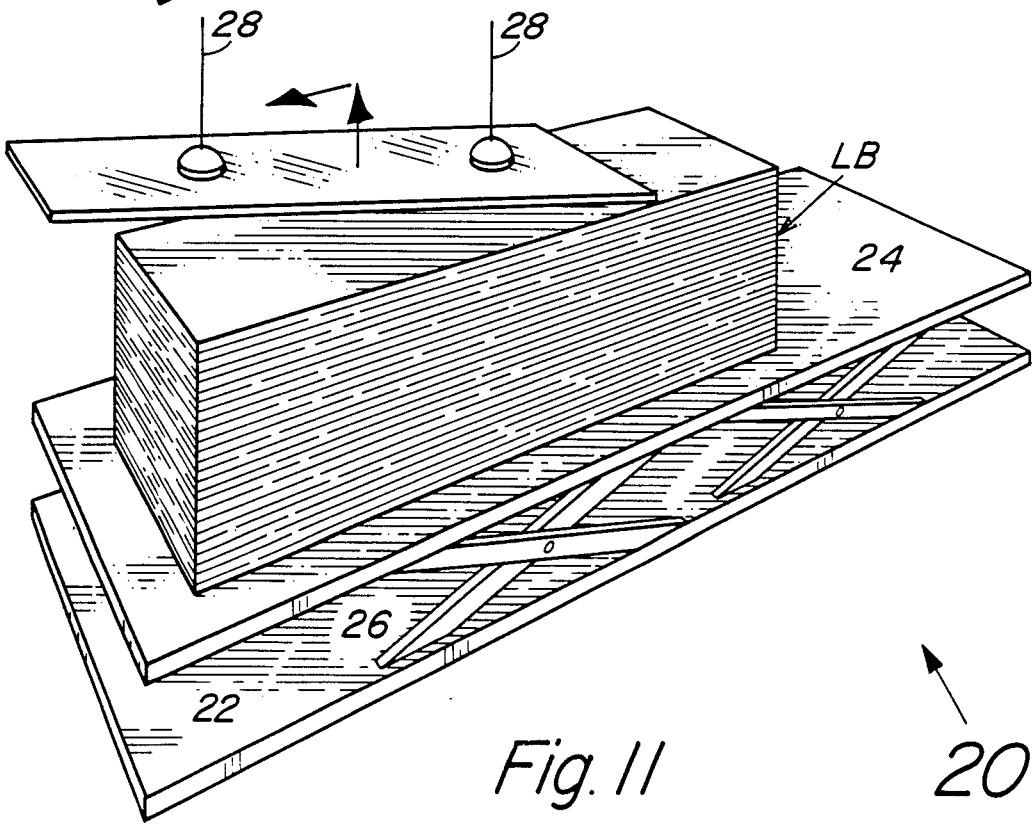

It will be understood that, for purposes of clarity, certain elements have been intentionally omitted from certain views where they are believed to be illustrated to better advantage in other views.

DESCRIPTION OF THE PREFERRED EMBODIMENT

Laminated bulk boxes or containers are typically manufactured on equipment which either manually or automatically feeds a flat body blank with the inside surface up into a laminated area. A liner blank is then either manually or automatically fed across a glue applicator station, which applies glue to the bottom of the liner blank, and then into the laminating area where it is positioned on the body blank.

The body and liner blanks are both usually prescored. when the combination body and linear blanks have been clamped together long enough to assure a glue bond, the laminated sheet is transferred to subsequent stations to glue the manufacturers joint, fold, press, and stack finished boxes in knocked down condition.

Since the containers produced in this manner are generally large with thick walls, they usually have to be stacked with alternate containers rotated 180 degrees to avoid the accumulative effect of the thicker manufacturers joints occurring in the same place.

A major problem with production of this type is that a compromise must be struck between the cycle time, container quality, and container material cost. If prescored body and liner blanks are used, the quality of the box will not be as good as when scoring takes place after lamination of the blanks to each other.

If the scoring is done after lamination, the glue bond must be cured sufficiently to prevent shear during the process. This means additional holding time is required, which in turn either slows down the production rate or requires a larger machine occupying more space to increase the dwell time while the adhesive is curing. Another alternative is the use of a more rapid setting, and hence more expensive adhesive, such as hot melt.

Another problem common to existing laminating equipment resides in the application of glue to the bottom of the liner blank which then has to be transported to the laminating area.

Since liner blanks for bulk boxes are generally large, more elaborate but slower conveying equipment is required to transport a blank with adhesive on the under side thereof to the laminating area.

The purpose of the present invention is to improve the efficiency of the laminating process without requiring additional time or space for the operation of the equipment.

Turning now to the drawings for a better understanding of the invention, FIG. 10 is a schematic diagram illustrating the relative location of all of the operating stations required by the present invention to produce bulk containers from laminated sheet material. The stations include: the body blank and liner blank feed stations, indicated generally at 10 and 20, respectfully: the laminating station 30; the first clamping station 40; the scoring station 50; the folding station 60; the second clamping station 70; and the finished container take away station 80.

The body blank feed station is shown in FIG. 1. There the body blanks BB are positioned on a lift table indicated generally at 10. The table includes a lower platforms 12 and upper platform 14 which are interconnected by an elevating mechanism 16, so the upper platform can be positioned at the appropriate height regardless of the number of blanks stacked thereon. The body blanks BB can be transferred from the lift table to the adjacent laminating station by a conventional vacuum transfer means indicated generally at 18.

At the liner blank feed station the liner blanks LB are also maintained on lift table 20 which includes a lower platform 22 and an upper platform 24 interconnected by an elevating mechanism 26. The liner blanks may be also transferred to the laminating station by conventional vacuum transfer means 28.

The details of tables 10 and 20 are not shown, because they are of the standard type, such as the LSC LARGE LIFTS manufactured by the West Bend Equipment Company of West Bend, Wisconsin.

Positioned adjacent the body blank and liner blank feed stations is the laminating station, indicated generally at 30 and illustrated in FIG. 3. The laminating station apparatus includes a frame 31 having at one end thereof a pair of nip or feed rollers 32 adapted to transfer a liner blank LB into the laminating station. Mounted on frame 31 is a glue applicator, indicated generally at 33, capable of applying an adhesive to the upper surface of a linear blank as it enters the laminator and moves onto conveyor belts 34. The belts are driven by an actuating mechanism indicated generally at 35.

After the body and linear blank have been laminated to each other, in a manner hereinafter described, to form a laminated sheet LS, the sheet is conveyed to first clamping stations 40 by means of a conveyor 36 driven by an actuating mechanism 38 mounted on frame 31. The conveyor and driving mechanism are not shown in great detail as they may be of a conventional nature. Preferably the conveyor 36 comprises a pair of chains having spaced flights thereon.

The first clamping station is illustrated in FIGS. 4 and 9. The equipment at the first clamping station includes a frame 41 supporting a horizontal shaft 42 to which are affixed a plurality of circumferentially spaced, radially extending clamping members.

Each of the clamping members includes a fixed plate 43 and a movable plate 44 which define a compressible pocket therebetween, as best seen in FIG. 3. Movement of plate 44 of one member toward and away from related plate 43 is accomplished by an operating mechanism best seen in FIG. 9. It includes a base plate 45, attached to the rear of a fixed plate 43 of an adjacent member by means of support bracket 46, and an actuating mechanism 47 comprising a pair of hydraulic or pneumatic cylinders positioned between the base plate 45 and the movable plate 44 of the one clamping member.

After the laminated sheets pass through the first clamping station they are transferred by conveyor to scoring station 50 which is illustrated in FIG. 5 of the drawings.

The apparatus of the scoring station includes a frame 51 having a platform 52 for receiving the laminated sheets, one at a time. Positioned on the frame above the platform are scoring tools 54 which are actuated by mechanisms 56 to form fold lines in a laminated sheet disposed on platform 52.

After the sheets have been scored they are transferred by another chain type conveyor 58 to a sheet folding station, indicated generally at 60 and illustrated in FIG. 6.

As the scored sheets are transferred to the folding station, glue may be applied by a conventional applicator (not shown) to the manufacturers joint edge surfaces at each end of the blank.

The apparatus of folding station 60 includes a frame 61 and a horizontal platform 62. Mounted on the frame are pairs of cantilevered fold arm 63 attached to shafts 64 which are each rotated by a rack and pinion mechanism 65 and an actuator cylinder 66.

After the sheets have been folded into tubular structures they are transferred by another conveyor 68 to a second clamping station, indicated generally at 70 and illustrated in FIG. 7.

The apparatus of second clamping station 70 includes a frame 71 and platform 72 for receiving the scored, glued, and folded laminated sheets LS.

At the second clamping station clamping pressure is applied by means of a compression plate 74 operated by an actuator mechanism indicated generally at 76. Thus, the tubular structures are converted into finished containers in knocked down condition.

The containers are then transferred by a vacuum transfer means 78 to the container take away station and placed on a stacker lift turntable, indicated at 80 and illustrated in Figure 8. The turntable includes a lower platform 82 and upper platform 84 connected by an elevating mechanism indicated at 85. Mounted on the upper platform 84 is a turntable 86 which supports an upper deck 88 adapted to hold the finished containers in flat or collapsed condition.

Now to described the operation of the invention, after a glued liner blank LB is fed on to conveyor belts 24 at the laminating station, a body blank is then deposited on top of the liner blank to form a laminated sheet LS. The laminated sheets then pass, one at a time, to the apparatus of the first clamping station, where they are received in separate individual clamping members.

The clamping station is in the form of a ferris wheel to permit several laminated sheets to be held and clamped at the same time to extend the curing time of the adhesive without occupying the space required by a conventional conveyor. After adhesive of the sheet has been curved, the sheets pass to the scoring station where fold scores are formed therein by scoring tools 54.

After the scoring operation has been completed the sheets pass to the folding station 60 after glue has been applied to end edges of the sheet. Then the ends of the sheet are folded together to form a tubular structure which is then transferred to the second clamping station 70 where pressure is applied to seal the manufacturers joint and thereby complete the making of the container.

After completion the finished containers are transported by a vacuum transfer means 78 to the container take away station and away station and deposited on the upper deck of a stack lift turntable 80. Turntable 80 includes lower and upper platforms 82 and 84 connected by an elevating mechanism 85. An upper, container receiving deck 86 is mounted on a rotatable turntable 88 carried on upper platform 84. Upper deck 88 rotates 180 degrees each time a new container is deposited thereon to maintain the stack of containers level.

Thus, it will be appreciated that the invention provides a novel and effective means of forming bulk containers from laminated paperboard sheets in a highly efficient manner and with equipment which occupies a minmum amount of floor space.

What is claimed is:

1. Appartus for making a bulk container from a pair of outer body and inner liner blanks of foldable sheet material, such as paperboard, which are laminated together, scored, folded, and glued to form a tubular structure, said apparatus comprising:

(a) a laminating station including means for bringing a body blank and a linear blank together in face to face relation and interposing adhesive therebetween to form a laminated sheet;

(b) a first clamping station including means for receiving a plurality of said laminated sheets, one at a time, and simultaneously clamping several while said adhesive is curing, said clamping stations comprising:

(i) a frame;

(ii) a shaft carried by said frame for rotation about a horizontal axis;

(iii) a plurality of circumferentially spaced clamping members extending radially outward from said shaft and each comprising a fixed plate, a movable plate, and means for moving the movable plate toward and away from the fixed plate;

(c) said plate, moving means comprising:

(i) a support bracket mounted at rear side of a fixed plate of one clamping member;

(ii) a base plate carried by said support bracket;

(iii) cylinder means interposed between said base plate and a movable plate of an adjacent clamping member and operable to move said movable plate toward and away from a fixed plate of said adjacent clamping member;

(d) a scoring station including means for forming folding scores in said laminated sheets;

(e) a folding station including means for folding opposite ends of said laminated sheet into overlapped relation to form a tubular structure;

(f) a second clamping station including means for clamping said tubular structure to complete the making of a container;

(g) conveyor means for transferring said blanks and sheets between said stations.

2. Apparatus for making a bulk container from a pair of outer body and inner linear blanks of foldable sheet material, such as paperboard, which are laminated together, scored, folded, and glued to form a tubular structure, said apparatus comprising:

(a) a laminating station including means for bringing a body blank and linear blank together in face to face relation and interposing adhesive therebetween to form a laminated sheet;

(b) a first clamping station including means for receiving a plurality of said laminated sheets, one at a time, and simultaneously clamping several while said adhesive is curing, said clamping station comprising:

(i) a frame;

(ii) a shaft carried by said frame for rotation about a horizontal axis;

(iii) a plurality of circumferentially spaced clamping members extending radially outward from said shaft and each comprising a fixed plate, a movable plate, and means for moving the movable plate toward and away from the fixed plate;

(c) said means for moving the movable plate of one clamping member toward and away from the related fixed plate of said one clamping member including a cylinder mechanism interconnected between said movable plate and fixed plate of an adjacent clamping member;

(d) a scoring station including means for forming folding scores in said laminated sheets;

(e) a folding station including means for folding opposite ends of said laminated sheet into overlapped relation to form a tubular structure;

(f) a second clamping station including means for clamping said tubular structure to complete the making of a container;

(g) conveyor means for transferring said blanks and sheets between said stations.

* * * * *